US011178976B2

(12) United States Patent
Adams et al.

(10) Patent No.: US 11,178,976 B2
(45) Date of Patent: Nov. 23, 2021

(54) LOW AIR LOSS MATTRESS HAVING A LOW ACOUSTIC SIGNATURE AND INTERCHANGEABLE AIR PUMP CARTRIDGE

(71) Applicants: Craig Adams, Jacksonville, OR (US); Anthony G DaCosta, Woodland Hills, CA (US)

(72) Inventors: Craig Adams, Jacksonville, OR (US); Anthony G DaCosta, Woodland Hills, CA (US)

( * ) Notice: Subject to any disclaimer, the term of this patent is extended or adjusted under 35 U.S.C. 154(b) by 0 days.

(21) Appl. No.: 16/787,978

(22) Filed: Feb. 11, 2020

(65) Prior Publication Data

US 2021/0244194 A1 Aug. 12, 2021

(51) Int. Cl.

| | |
|---|---|
| ***A47C 27/08*** | (2006.01) |
| ***A47C 27/18*** | (2006.01) |
| ***A61G 7/057*** | (2006.01) |

(52) U.S. Cl.

CPC ..... *A47C 27/083* (2013.01); *A47C 27/082* (2013.01); *A47C 27/18* (2013.01); *A47C 27/081* (2013.01); *A61G 7/05769* (2013.01)

(58) Field of Classification Search

CPC ..... A47C 27/083; A47C 27/082; A47C 27/18; A47C 27/081; A47C 27/08; A47C 27/10; A61G 7/05769

USPC ..... 5/713, 714, 710, 706, 655.3, 654, 644

See application file for complete search history.

(56) References Cited

U.S. PATENT DOCUMENTS

| | | | | | |
|---|---|---|---|---|---|
| 4,989,283 | A * | 2/1991 | Krouskop | A47C 27/10 | 5/713 |
| 5,249,319 | A | 10/1993 | Higgs | | |
| 5,542,136 | A * | 8/1996 | Tappel | A61G 7/05776 | 5/658 |
| 5,815,864 | A * | 10/1998 | Sloop | A61G 7/05784 | 5/706 |
| 6,154,907 | A * | 12/2000 | Cinquin | A61G 7/05769 | 5/706 |
| 6,332,760 | B1 * | 12/2001 | Chung | F04D 25/084 | 417/239 |
| 6,793,469 | B2 * | 9/2004 | Chung | F04D 25/084 | 417/238 |
| 6,955,527 | B2 * | 10/2005 | Yen | F04B 35/04 | 417/360 |
| 7,127,762 | B1 * | 10/2006 | Lau | A47C 27/082 | 5/713 |

(Continued)

*Primary Examiner* — Robert G Santos

(74) *Attorney, Agent, or Firm* — Morland C. Fischer

(57) ABSTRACT

A low air loss mattress to provide a variable pressure to an individual who is confined to a bed. The mattress has an air plenum and a motor driven blower to inflate the air plenum. The blower is housed within a pull-out and interchangeable pump cartridge that is received within a pump cartridge receptacle inside the mattress. The pump cartridge is removable from the pump cartridge receptacle to permit the blower to be repaired or replaced without having to discard the mattress. Ambient air is supplied to the blower by way of a tuned air pump inlet path that winds between a pair of sound absorbing blocks. Air is blown front the blower to the air plenum by way of a tuned air manifold that is located inside the mattress to inflate the air plenum. Bluetooth compatible sensors located inside the mattress are responsive to physical parameters to which the mattress is subjected.

19 Claims, 7 Drawing Sheets

(56) References Cited

U.S. PATENT DOCUMENTS 7,284,291 B2 * 10/2007 Wang ..... A47C 27/081 5/711
7,409,735 B2 * 8/2008 Kramer ..... A47C 27/082 5/713
7,922,461 B2 * 4/2011 Wang ..... F04D 29/503 417/411
RE42,559 E * 7/2011 Wang ..... F04D 25/0673 417/411
8,657,565 B2 * 2/2014 Coleman ..... F04D 25/084 415/121.2
9,211,018 B2 * 12/2015 Wang ..... F04D 29/503
9,289,072 B2 * 3/2016 Albero ..... A47C 21/044
10,543,138 B2 * 1/2020 Shih ..... A61G 7/05769
2001/0026763 A1 * 10/2001 Chung ..... F04D 29/601 417/360
2004/0037717 A1 * 2/2004 Wang ..... F04D 25/084 417/411
2004/0241014 A1 * 12/2004 Yen ..... F04B 35/04 417/360
2005/0118046 A1 * 6/2005 Wang ..... F04D 29/503 417/423.15
2006/0085919 A1 * 4/2006 Kramer ..... A47C 27/083 5/713
2006/0213013 A1 * 9/2006 Wang ..... A47C 27/081 5/713
2006/0253993 A1 * 11/2006 Lau ..... A47C 27/082 5/713
2011/0259453 A1 * 10/2011 Coleman ..... F04D 25/084 137/565.17
2014/0201919 A1 * 7/2014 Albero ..... A61G 7/057 5/644
2018/0325761 A1 * 11/2018 Shih ..... A61G 7/05769
2019/0262201 A1 * 8/2019 Borgman ..... A61B 6/0407
2021/0227990 A1 * 7/2021 Looslie ..... A47C 27/083
2021/0244194 A1 * 8/2021 Adams ..... A47C 27/083

* cited by examiner

LOW AIR LOSS MATTRESS HAVING A LOW ACOUSTIC SIGNATURE AND INTERCHANGEABLE AIR PUMP CARTRIDGE

BACKGROUND OF THE INVENTION

1. Field of the Invention

This invention relates to a low air loss mattress having a low acoustic signature and a variable pressure which may be selectively controlled according to the needs of a user such as, for example, an individual who is confined to a bed in a hospital or other health care facility. Air is supplied to inflate an air plenum inside the mattress by a motor driven pump which is housed inside the mattress in a pull-out pump cartridge. The pump cartridge is removable and interchangeable so that the pump can be conveniently repaired or replaced outside the mattress.

2. Background Art

Conventional low air loss variable pressure mattresses that are found in a healthcare facility to support a bed-ridden individual are usually inflated with air by either a hose that is attached to a remote pump or blower assembly or by an internal non-removable pump or blower. Such conventional low air loss mattresses are able to help patients reduce possible tissue necrosis that is often referred to as bed sores.

Despite this advantage, conventional low air loss mattresses generate background noise, and the acoustic signatures of their pump or blower assemblies often deprive patients of their opportunities to rest or sleep. In some cases, these pumps and blower assemblies lie in acoustic ranges that may be unpleasant to humans. In general, the conventional low air loss mattress system is loud, requires large amounts of AC voltage, has many components, and an internal pump blower assembly that is heavy, fixed in place and difficult to service. What is more, conventional low air loss mattresses are not known to be provided with self-contained battery backup that is available for use in the event of power outages or interruptions in their electrical system.

Accordingly, an improved low air loss variable pressure mattress is desirable that is able to overcome the aforementioned problems. In particular, a low air loss variable pressure mattress is needed that is manufactured from a sound absorbing material adapted to provide the mattress with a low acoustic signature that will not be offensive and interfere with the ability of a bed-ridden patient to rest or sleep on the mattress. It would also be desirable to be able to inflate the mattress with a blower (e.g., a motor driven air pump) that is housed inside the mattress in a pull-out pump cartridge which can be easily removed from the mattress to facilitate a repair or replacement of the blower without having to discard the mattress.

SUMMARY OF THE INVENTION

In general terms, disclosed herein is a low air loss variable pressure mattress having a low acoustic signature that is ideal for use in a hospital, at home, or in a health care facility to support the weight of a bed-ridden individual. The low air loss mattress includes an inflatable air plenum therewithal that is formed from a series of air cells to be filled with air. Air with which the air plenum is inflated is continuously leaked to the atmosphere. The low air loss mattress also includes therewithin a pump cartridge receiving receptacle.

As an important improvement to the mattress of this invention, an interchangeable pull-out pump cartridge is removably received within the cartridge receiving receptacle. In one embodiment, the pull-out pump cartridge carries an air pump to blow air under pressure to inflate the air cells of the air plenum and a variable speed electric motor to drive the air pump and control the pressure of the mattress. The pump cartridge is removable from the cartridge receiving receptacle to permit a replacement thereof or a repair of the air pump or its motor without having to dispose of the mattress.

The air pump of the removable pump cartridge communicates with the air cells of the inflatable air plenum by way of a tuned air manifold that runs longitudinally through the air plenum. Air outlet diffusers branch off the air manifold into respective ones of the air cells. Each air outlet diffuser terminates in one of the air cells at an air outlet tip. To reduce the noise made by the air being blown by the air pump into the air cells, the cross-sectional area of the outlet tips is larger than the cross-sectional area of the air outlet diffusers. To reduce the noise made by the ambient air being drawn into the air pump, the incoming air is supplied to the air pump by way of a tuned air inlet path that winds between a pair of sound absorbing (e.g., foam) blocks. The winding air inlet path has alternating narrow turned sections and relatively wide straight sections.

A pair of electrical wires run along the tuned air manifold to provide power (e.g., 5 volts DC) to a series of ultrasonic sensors that are connected to the wires and responsive to one or more physical parameters (e.g., temperature). The sensors communicate information over a wireless (e.g., Bluetooth) communication path to a (e.g., a single board) computer that is located within the removable pump cartridge. The computer is adapted to send sensor data to a remote storage device over a wireless (e.g., Bluetooth) communication path. The pump cartridge also carries a backup battery supply to power the computer in the event of an AC power interruption. The computer supplies power to the series of sensors by way of the pair of electrical wires to which the sensors are connected.

DESCRIPTION OF THE PREFERRED EMBODIMENT

Figure 1:
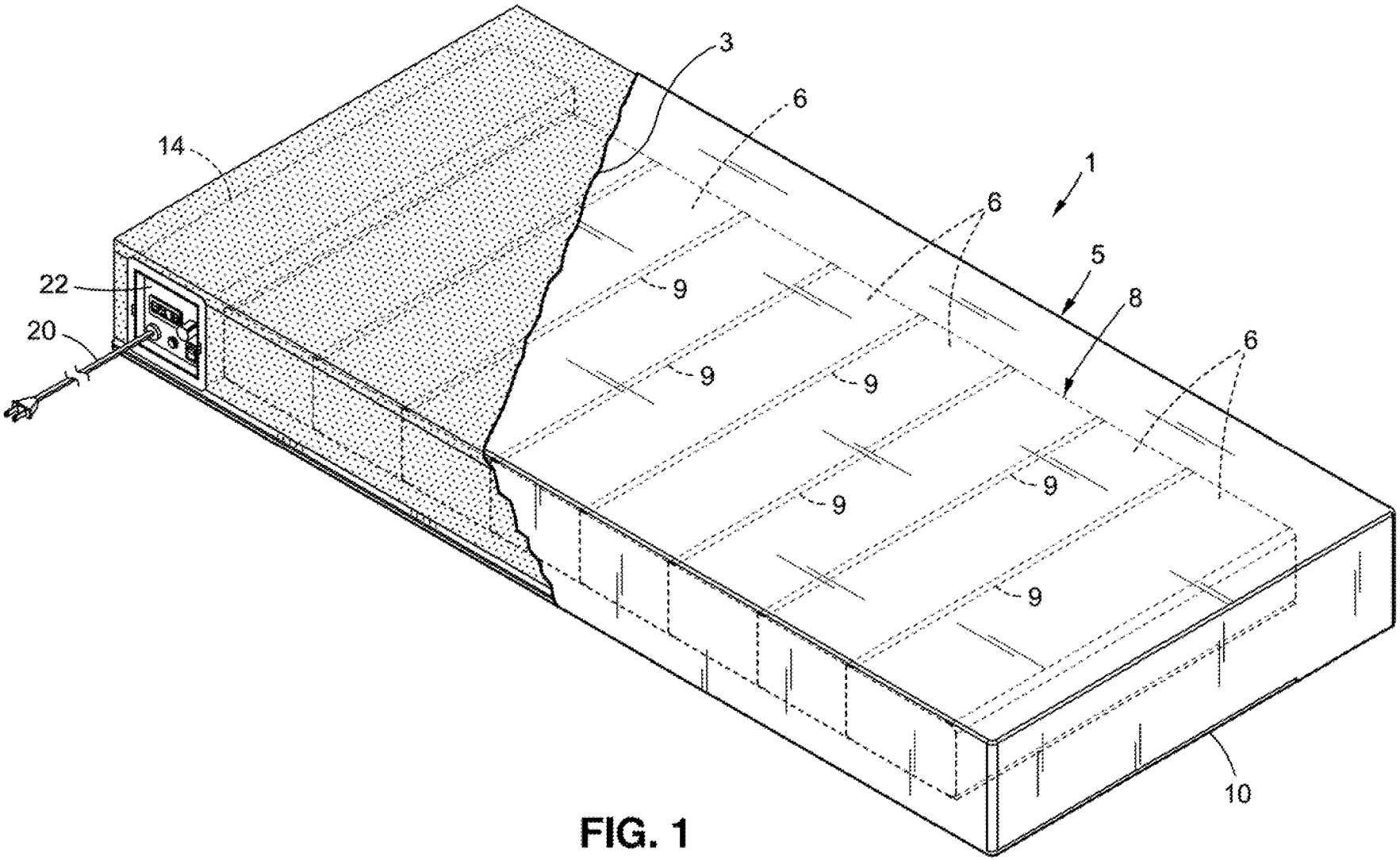
FIG. 1 is a partially broken away perspective view of an improved low air loss variable pressure mattress having a low acoustic signature and removable and interchangeable air pump cartridge.
Figure 2:
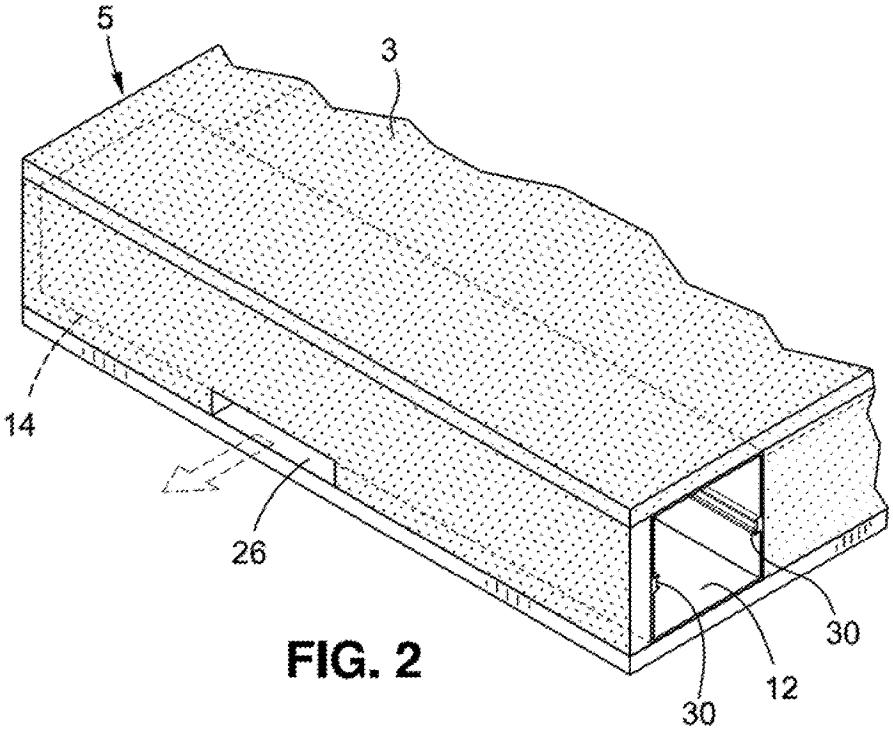
FIG. 2 is an enlarged detail of the low air loss variable mattress of FIG. 1 showing a pump cartridge receiving receptacle from which the interchangeable air pump cartridge has been removed.
Figure 3:
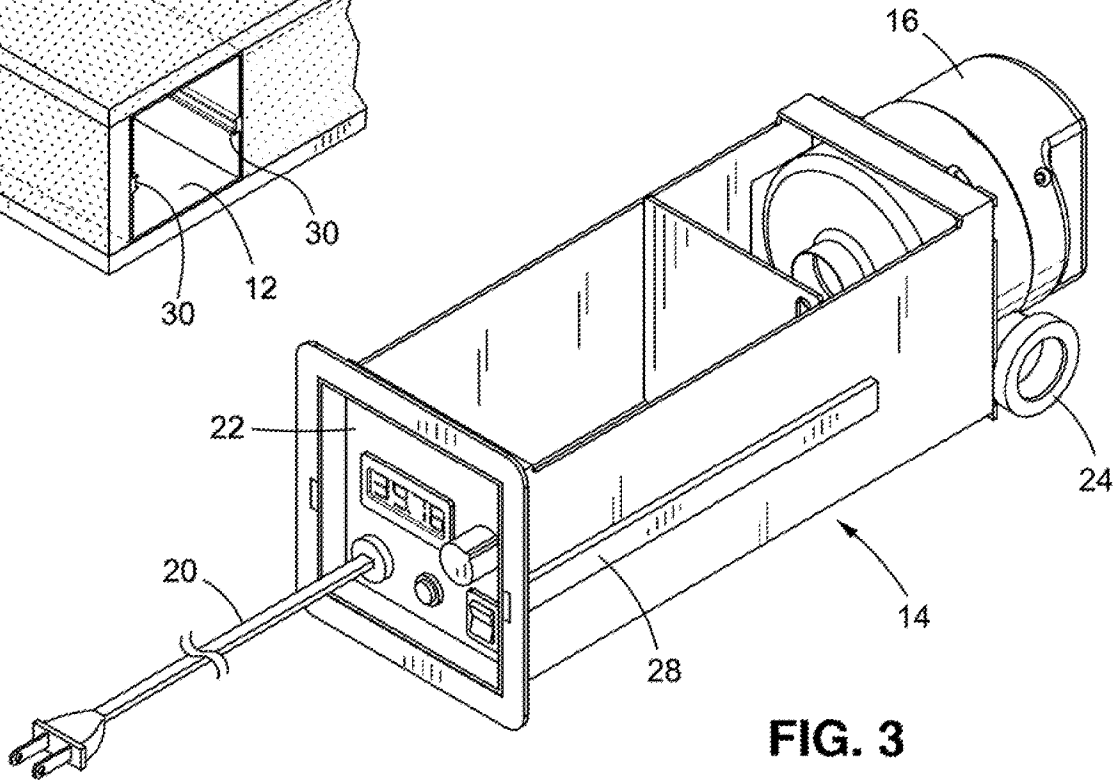
FIG. 3 shows the removable and interchangeable air pump cartridge following its removal from the pump cartridge receiving receptacle of FIG. 2.
Figure 4:
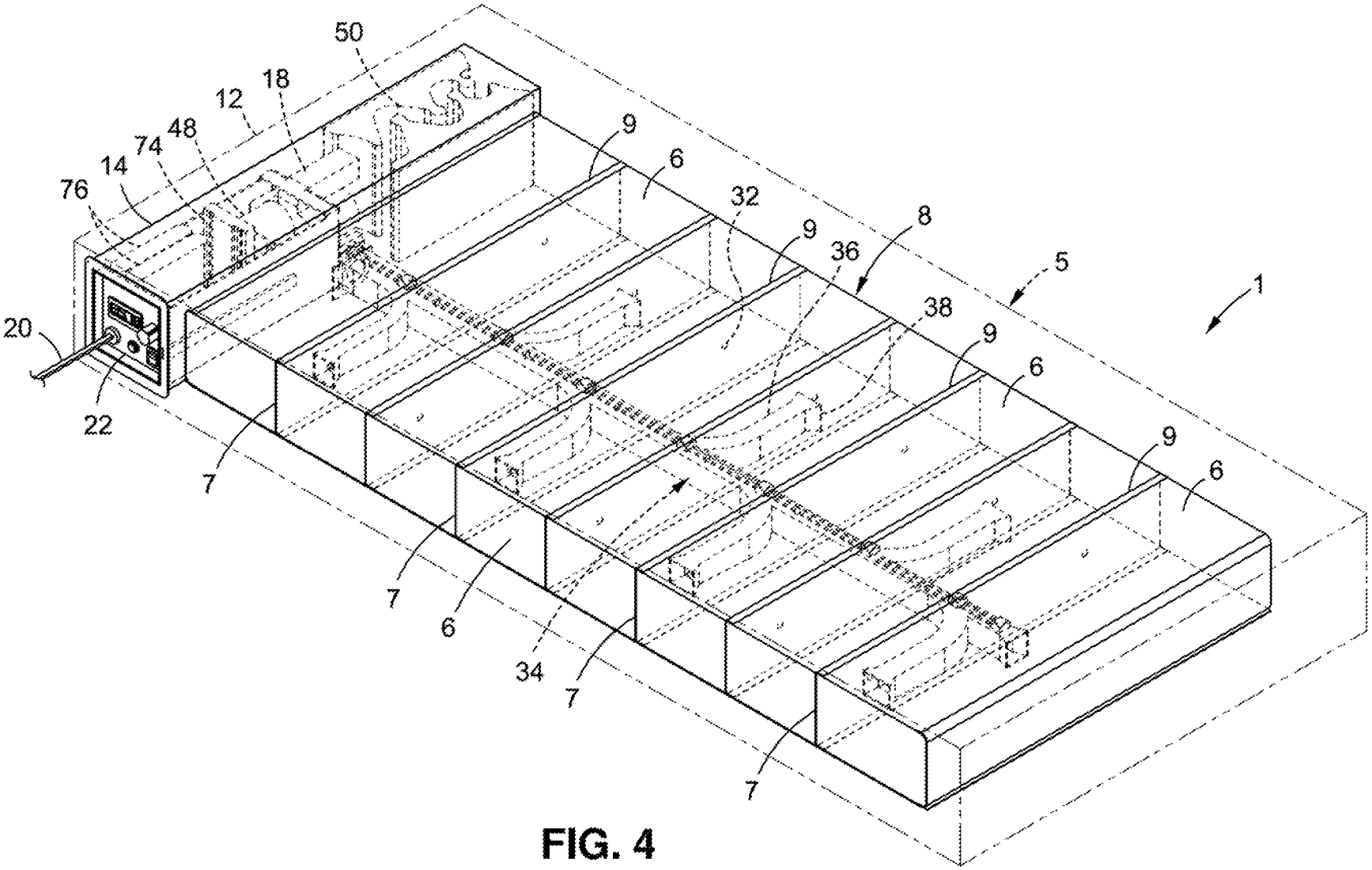
FIG. 4 is a perspective view showing an inflatable air plenum of the low air loss variable pressure mattress and tire removable and interchangeable air pump cartridge located within the pump cartridge receiving receptacle.

Referring initially to FIGS. 1-3 of the drawings, there is shown a low air loss mattress 1 of the kind on which a bed-ridden individual is resting and/or sleeping. The low air loss mattress 1 has particular application for providing a variable pressure to support the weight of the individual and reduce the likelihood that he or she will sustain tissue damage (e.g., bed sores) as a consequence of laying on an otherwise continuously firm surface for prolonged periods of time. The low air loss variable pressure mattress 1 would typically be used on a bed found in a hospital. However, the mattress 1 may also be found at home or in any treatment facility where long term care is being provided to a bed-ridden individual.

The low air loss variable pressure mattress 1 is surrounded by a removable, tear-resistant liner 3 that is air permeable. The liner 3 in turn surrounds a mattress core 5 that is manufactured from a resilient material such as open cell foam or the like. The mattress core 5 has a density that is suitable to comfortably support the weight of an individual lying thereon.

The mattress core 5 is divided into a plurality of hollow air cells (i.e., chambers) 6 that are aligned side-by-side and extended laterally across the core 5. The air cells 6 are separated from one another by end walls 7 by which to create an air plenum 8. The end walls 7 of the air plenum 8 are attached to the mattress core 5 by means of stitching 9. The air that is pumped under pressure into the air cells 6 to inflate air plenum 8 will continuously leak therefrom through the stitching 9. The air leaked through the stitching 9 is exhausted through the air permeable liner 3 into the atmosphere within which the mattress 1 is located. A zipper 10 can be opened to allow the liner 3 to be removed from the mattress core 5.

Located within one end of the mattress core 5 adjacent the air plenum 8 is a pump cartridge receiving receptacle 12. As is best shown in FIG. 2, the receptacle 12 extends laterally through the mattress core 5 and is sized to removably receive therewithin a pull-out pump cartridge 14. As an important advantage of this invention and as an improvement over currently known conventional low air loss mattresses, the pump cartridge 14 is removable from the pump cartridge receiving receptacle 12. By virtue of the foregoing, and as is best illustrated by FIG. 3, the pump cartridge 14 can be removed from the mattress to be repaired or interchanged with a new pump cartridge without having to damage or discard the mattress 1 within which the pump cartridge is carried.

Referring particularly to FIG. 3, the removable and interchangeable pump cartridge 14 creates a protective housing for a portable motor driven air pump or blower. By way of a first preferred embodiment, the pump cartridge 14 shown in FIG. 3 (and in FIGS. 5 and 9) has an integral blower and motor combination 16 such as, for example, that known commercially as the Ametek Windjammer Thru flow Model No. 116630-03. An AC power cord 20 is connected to the blower 16 to provide power thereto through a manually accessible control panel 22 that is located at the outside face of the pump cartridge 14. An air pump exhaust port 24 communicates with the pump cartridge 14 so that air under pressure can be supplied from the blower 16 to each of the air cells 6 of the air plenum 8 shown in FIG. 1. As is best shown in FIG. 2, a heat exhaust port 26 extends outwardly through the mattress core 5 from the pump cartridge receiving receptacle 12 to the atmosphere by which to remove heat generated during the operation of the blower 16.

The removable, pull-out pump cartridge 14 shown in FIG. 3 has a guide rail 28 running longitudinally along each side thereof from the control panel 22, The pump cartridge receiving receptacle 12 shown in FIG. 2 within which the pump cartridge 14 is removably received has a longitudinally extending groove 30 formed in each side thereof. The guide rails 28 of the pump cartridge 14 are slidably received within and ride through respective ones of the grooves 30 of the receptacle 12 to guide the receipt and the removal of the pump cartridge 14 and the blower and motor combination 16 thereof into and out of pump cartridge receiving receptacle 12 in response to pushing and pulling forces applied thereto.

Figure 5:
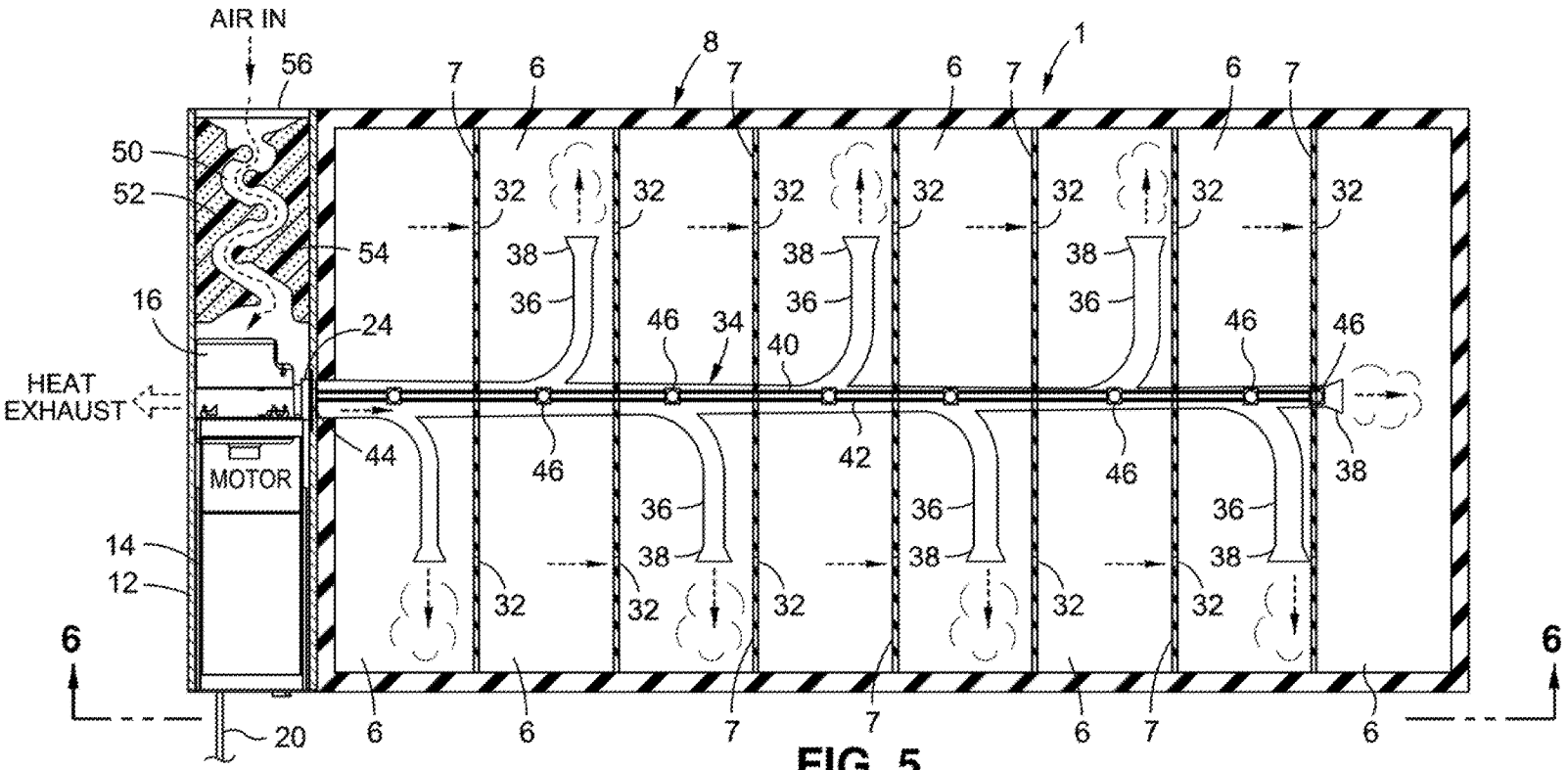
FIG. 5 is a cross section of the low air loss variable pressure mattress of FIG. 1 showing the removable and interchangeable air pump cartridge located within the pump cartridge receiving receptacle and an air pump thereof communicating with each of a plurality of air cells of the air plenum of FIG. 4 by way of a tuned air manifold.
Figure 6:
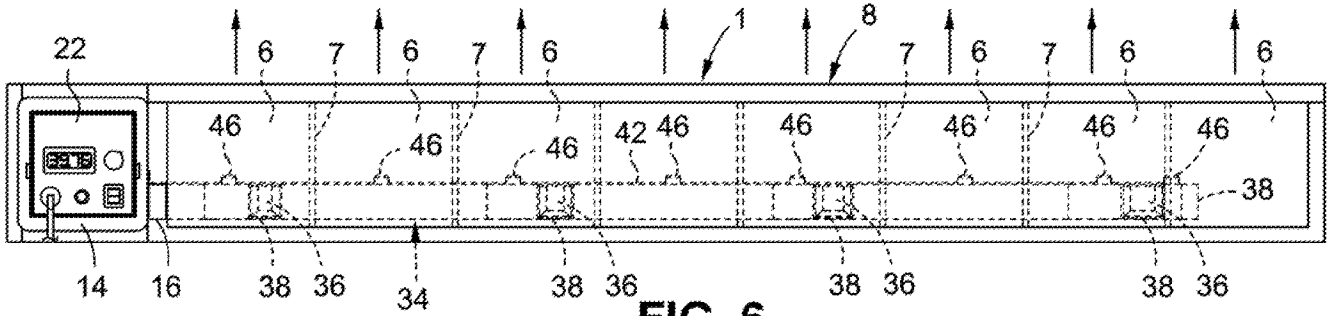
FIG. 6 is a front view of the low air loss variable pressure mattress of FIG. 1 viewed along lines 6-6 of FIG. 5.

Referring now to FIGS. 4-8 of the drawings, an air distribution path is described by which air under an adjustable pressure is blown to inflate each of the air cells 6 of the air plenum 8 into which the mattress core 5 of the low air loss mattress 1 is divided. By way of an alternate preferred embodiment, the pump cartridge 14 shown in FIGS. 4, 7 and 8 has an ultra-low acoustic, multi-lobe rotary air pump 18 such as, for example, that sold commercially by Denso of Japan as Model No. AMR-300. The air pump 18 is powered by a variable speed electric motor 48. As shown in FIG. 5, the air cells 6 of the air plenum 8 communicate with one another by way of air holes 32 formed through the end walls 7 that separate the air cells from one another A tuned air manifold 34 extends continuously from the air pump exhaust port 24 through each of the air cells 6 of the air plenum 8. As is also shown in FIG. 5, air outlet diffusers 36 branch off the air manifold 34 to extend into respective ones of the air cells 6. Each air outlet diffuser 36 terminates at an air outlet tip 38 located within one of the air cells 6. The cross-sectional area of the air outlet tips 38 is adjusted (e.g., made larger) relative to the cross-sectional area of the air outlet diffusers 36 until any noise caused by the air that is supplied to the air cells 6 via the outlet tips 38 is eliminated or substantially reduced.

Figure 7:
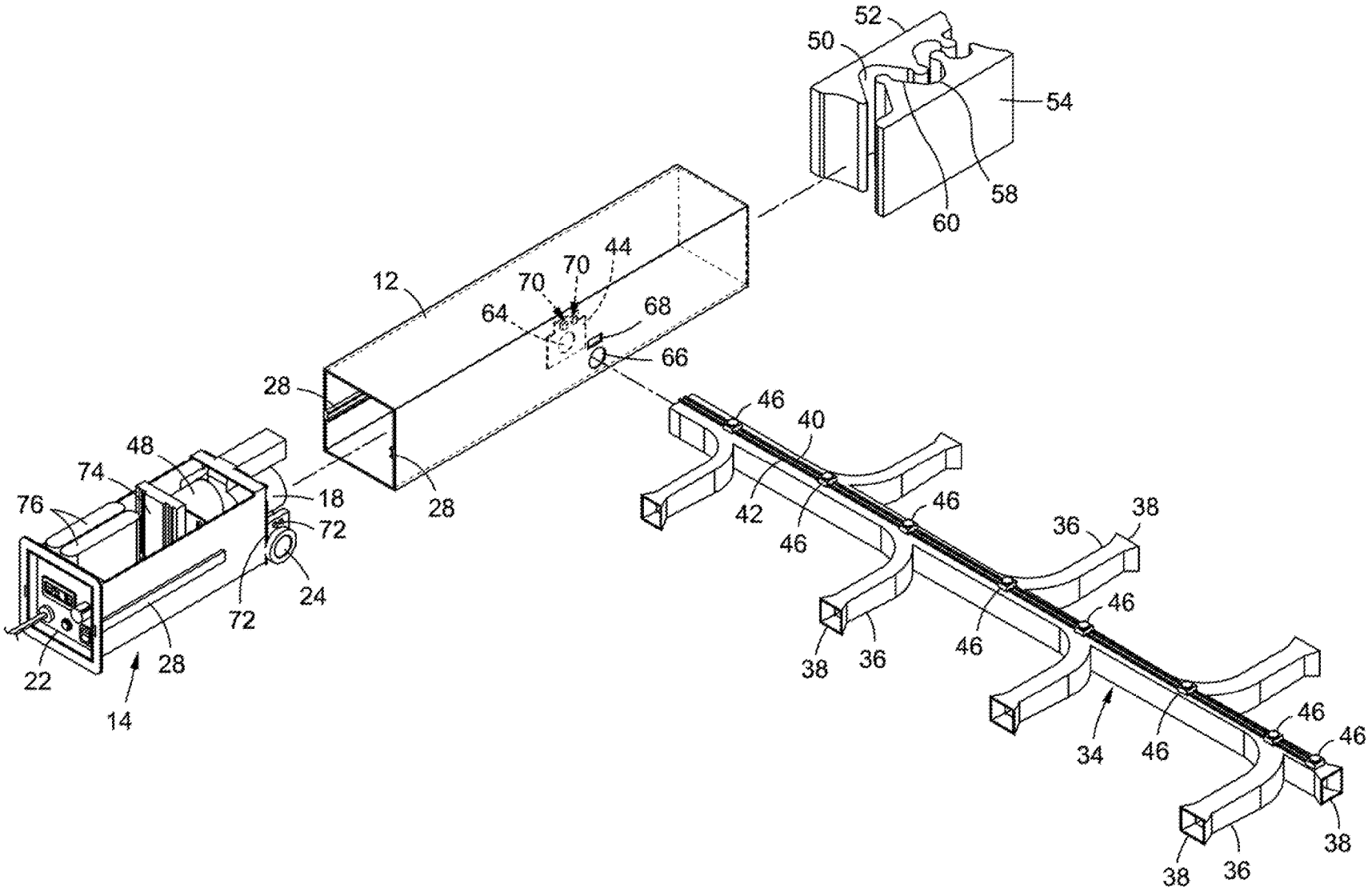
FIG. 7 is an exploded view of the removable and interchangeable air pump cartridge, the pump cartridge receiving receptacle from which the air pump cartridge has been removed, and the tuned air manifold shown in FIG. 5.

A pair of low voltage (e.g., 5 volts DC) electrical wires 40 and 42 run down the air plenum 8 along the top of the tuned air manifold 34 from an electrical interface plate 44 that is located inside the pump cartridge receiving receptacle 12 (best shown in FIG. 7). A series of ultrasonic sensors 46 at e connected to the pair of electrical wires 40 and 42 so that the sensors lie in respective ones of the plurality of air cells 6. The sensors 46 are responsive to any one of a variety of physical parameters that might be useful to those caring for the individual who is lying on the mattress 1. By way of example only, the sensors 46 may be acoustic, pressure or temperature sensors, such as those which are Bluetooth compatible.

The blower 16 or air pump 18 that is transported with the pull-out pump cartridge 14 blows air from the air exhaust port 24 thereof through the tuned air manifold 34 and into tire air cells 6 to inflate the air plenum 8 inside the core 5 of the low air loss mattress 1. Ambient air is drawn into the blower 16 of FIG. 5 or the air pump 18 of FIGS. 4 and 7 by way of a tuned acoustic signature reducing air pump inlet path 50 that winds between a pair of opposing sound absorbing barriers (e.g., blocks) 52 and 54 that are separated from one another by the inlet path 50.

Figure 8:
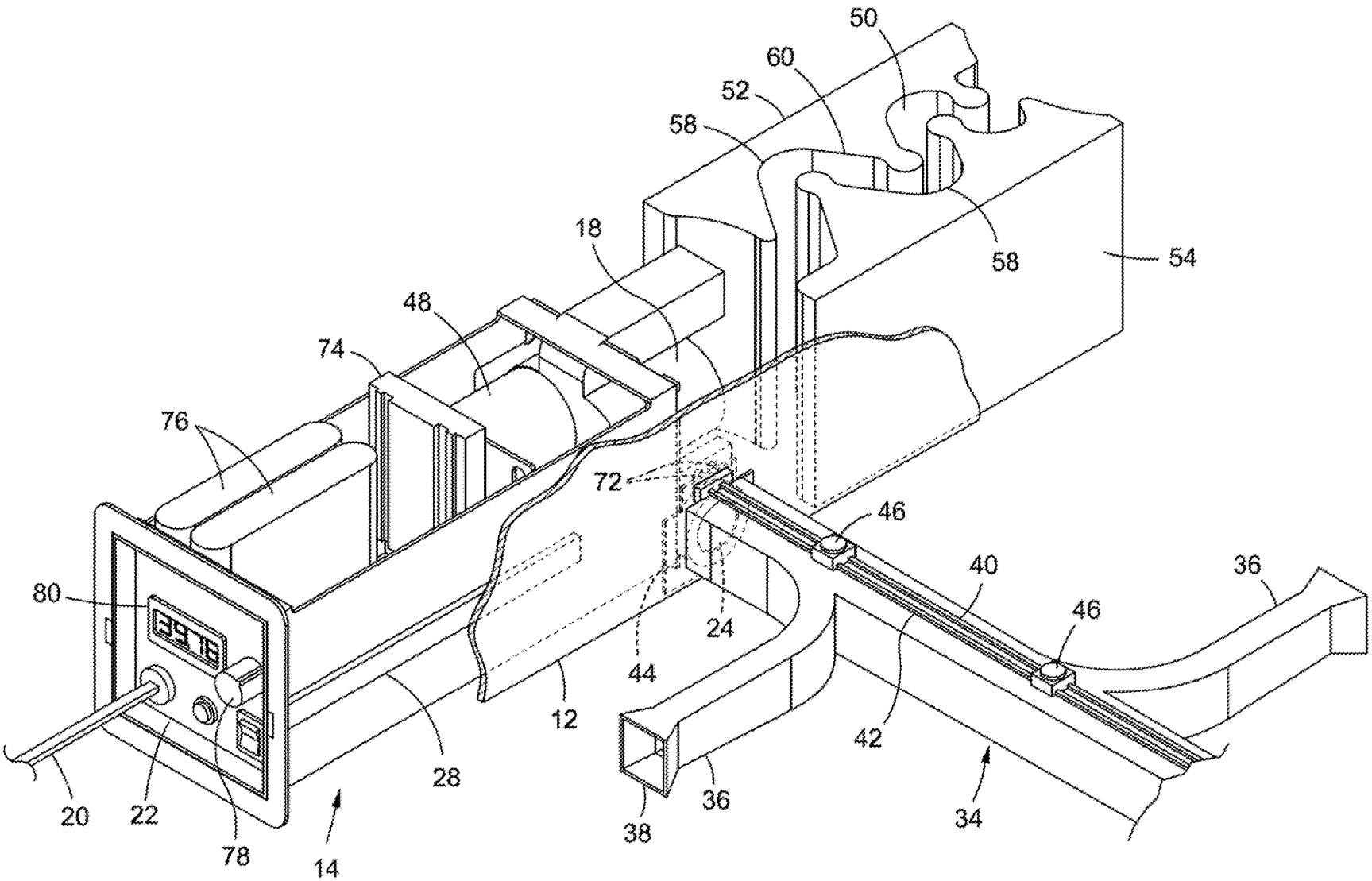
FIG. 8 shows the removable and interchangeable air pump cartridge having an analog display and a first blower, the pump cartridge receiving receptacle within which the pump cartridge is removably received, and the tuned air manifold of FIG. 7 in an assembled configuration.

The pair of sound absorbing blocks 52 and 54 are located at the rear of the pump cartridge receiving receptacle 12 adjacent the blower 16 or air pump 18 to which the inlet ambient air is provided via inlet path 50. By way of example, the sound absorbing barrier blocks 52 and 54 are manufactured from a sound absorbing material such as an open cell neoprene foam or the like. An air filter 56 extends across the air pump inlet path 50. The air pump inlet path 50 is acoustically tuned to reduce turbulence and the corresponding sound made by the incoming inlet air by forming the winding air path 50 with alternating narrow turns 58 and wider straight sections 60. That is to say and as is best shown in FIGS. 7 and 8, the cross-sectional area of the tuned air pump inlet path 50 continuously changes from wide to narrow to wide with respect to the alternating straight (wide) 60 and turned (narrow) 58 portions.

FIG. 7 is an exploded view showing the tuned air manifold 34 detached from the pump cartridge receiving receptacle 12 from which the pull-out pump cartridge 14 has been removed. FIG. 8 shows the tuned air manifold 34 connected to the receptacle 12 so as to communicate with the air pump exhaust port 24 of the pump cartridge 14 that is shown located within the receptacle 12. More particularly, air is blown from the air pump exhaust port 24 to the air manifold 34 through a pair of air outlet holes 64 and 66 (best shown in FIG. 7) that are axially aligned with one another and formed through each of the electrical interface plate 44 and the pump cartridge receiving receptacle 12 within which the interface plate is located (best shown in FIG. 8).

At the same time, the pair of low voltage electrical wires 40 and 42 that run along the tuned air manifold 34 to the sensors 46 are connected through a wire outlet 68 formed in the pump cartridge receiving receptacle 12 to respective ones of a pair of spring-loaded electrical contacts 70 that are mounted on a contact block atop the electrical interface plate 44. When the pull-out pump cartridge 14 is received within the receptacle 12, the contacts 70 at the interface plate 44 will be aligned for connection to respective ones of a pair of spring-loaded electrical contacts 72 that are mounted on the pump cartridge 14 above the air pump exhaust port 24. By virtue of the connection of the pairs of contacts 70 and 72 to one another, a low voltage (e.g., 5 volts DC) can be supplied to the pair of wires 40 and 42 in order to power the sensors 46. Power to the sensors 46 can also be supplied via a transformer (not shown) from a rectified AC voltage source.

As a unique feature of the low air loss variable pressure mattress 1 disclosed herein, a compact computer 74 is housed within the pull-out pump cartridge 14. One such compact computer 74 that is suitable to be housed within the pump cartridge 14 is a single board computer with Bluetooth capability such as that known as the Raspberry Pi computer available from the Raspberry Pi Foundation of the United Kingdom. The computer 74 can be powered from either an AC voltage source by way of the AC power cord 20 or, if the AC voltage source is interrupted or not available, from a DC voltage source by way of a back-up battery pack 76 located within the pump cartridge 14 nearby computer 74.

By virtue of its Bluetooth capability, the computer 74 is adapted to communicate over a wireless communication path with a remote data storage site (not shown) such as a smartphone, tablet or another computer at which data is stored concerning the physical parameters to which the string of sensors 46 is responsive. In this same regard, the sensors 46 that are connected to the pair of wires 40 and 42 are ideally adapted to broadcast information to which they are responsive to the computer 74 over a wireless Bluetooth communication path. What is more, power (e.g., a DC voltage) is delivered to the sensors 46 from the computer 74 along a circuit path that is completed when the pull-out pump cartridge 14 is removably received within the pump cartridge receiving cavity 12 of the mattress 1.

That is, and as previously explained, the circuit path from the computer 74 to the sensors 46 includes the series connection of the electrical contacts 72 mounted on the pump cartridge 14, the electrical contacts 70 mounted on the electrical interface plate 44 inside the pump cartridge receiving receptacle 12, and the pair of electrical wires 40 and 42 which run along the top of the tuned air manifold 34. To this end, the air pump exhaust port 24 of the pump cartridge 14 that is shown in FIGS. 7 and 8 and the electrical interface plate 44 at the inside of the pump cartridge receiving receptacle 12 are magnetically and detachably sealed one against the other so that the pairs of spring-loaded electrical contacts 70 and 72 are held in electrical contact with one another. At the same time, the air pump exhaust port 24 is positioned in axial alignment with the air outlet holes 64 and 66 formed through the electrical interface plate 44 and the pump cartridge receiving cavity 12. The electrical interface plate 44 is affixed (e.g., glued) to the tuned air manifold 34 to allow air to be blown from the air pump 18 into the manifold 34.

As is best shown in FIG. 8, located on and manually accessible at the control panel 22 of the pull-out pump cartridge 14 is an air pressure adjustment knob 78. The air pressure adjustment knob 78 is connected to the variable speed electric motor 48 within pump cartridge 14. A rotation of the knob 78 causes a corresponding adjustment to the speed of the motor 48 and the pressure of the air that is blown from the air pump exhaust port 24 into the air manifold 34 by which to inflate the air plenum 8 (of FIGS. 4 and 5) within the core 5 of the low air loss mattress 1. Accordingly, air will continuously escape from the air cells 6 of the plenum 8 through the stitching 9 (of FIG. 1) at the same time that the air cells 6 of the air plenum are inflated so that an individual laying on the mattress 1 will be advantageously supported by a variable pressure that can be selectively adjusted by rotating the air pressure adjustment knob 78 to meet the needs of the individual. An indication of the particular air pressure to which the air plenum 8 is inflated is provided by an analog display 80 that is also located at the control panel 22 at which to be responsive to a rotation of the air pressure adjustment knob 78.

Figure 9:
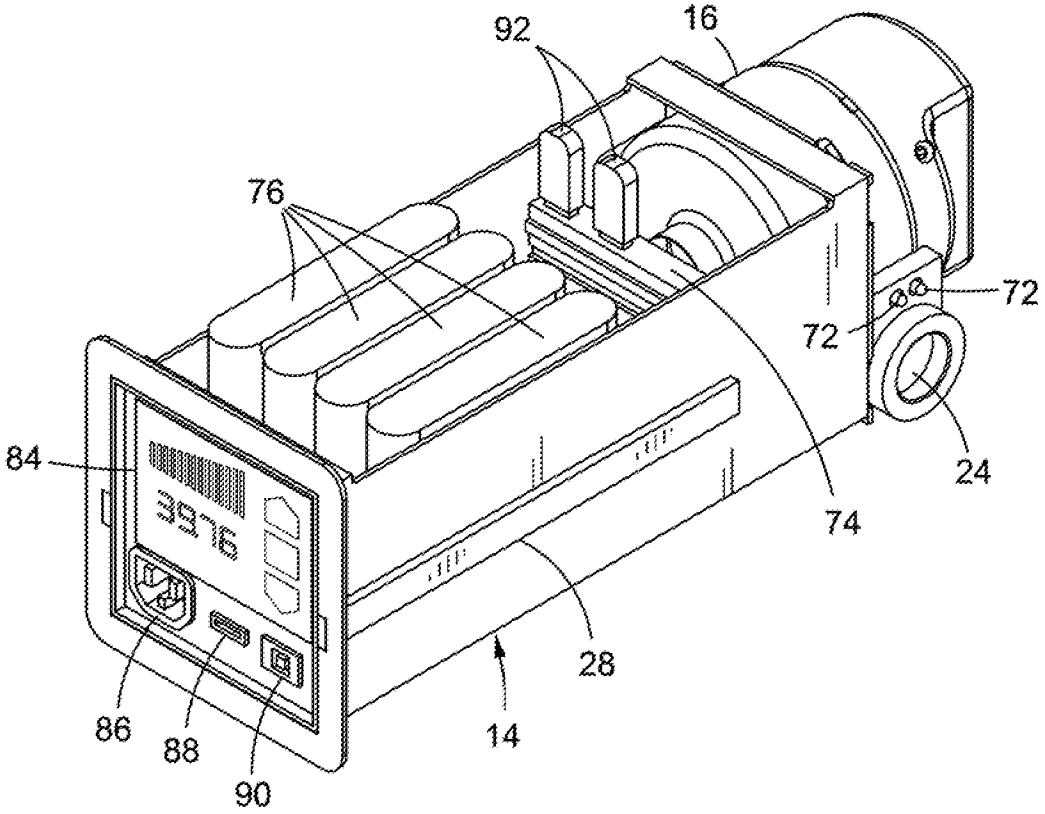
FIG. 9 shows the removable and interchangeable air pump cartridge having a digital display and an alternate blower with the pump cartridge removably received within the pump cartridge receiving receptacle.

FIG. 9 of tire drawings shows the pull-out pump cartridge 14 with a touch screen 82 located at the front face thereof in place of the control panel 22 that is shown in FIG. 8. The pump cartridge 14 of FIG. 9 is shown with the integral blower and motor combination 16 rather than the motor controlled air pump 18 of FIGS. 7 and 8. The touch screen 84 is connected (e.g., hard wired) directly to the computer 74 that is carried inside the pump cartridge 14. In this case, a digital indication of the adjustable air pressure of the mattress is available at the touch screen 82.

The touch screen 86 shown in FIG. 9 includes an AC plug receptacle 86 by which to be able to connect the computer 74 to an AC voltage source, a conventional USB port 88, and a fire wire port 90 from which large blocks of data regarding the individual who is laying on the mattress can be transmitted on a regular basis to a remote data collection site. Rather than having to rotate the air pressure adjustment knob 78 shown in FIG. 8, the touch screen 84 of FIG. 9 is responsive to touch pressure by which to selectively control the pressure of the air that is blown to inflate the air plenum 8 of FIG. 5. The computer 74 is shown in FIG. 9 having detachable flash drives 92 so that data collected by the computer can be transported to a remote computer for analysis.

The invention claimed is:

1. A combination comprising:

a mattress;

an air plenum located inside said mattress at which to be inflated with air by which to enable said mattress to support the weight of an individual laying thereon, said air plenum adapted to leak some of the air with which it is inflated to the atmosphere outside said mattress; and a blower located inside said mattress and coupled to said air plenum to blow air to said air plenum so that said air plenum is inflated at the same time that air is leaked therefrom to the atmosphere, said blower being uncoupled from said air plenum and removable from inside said mattress for repair or replacement;

a blower receiving receptacle located inside said mattress; and a pull-out blower cartridge within which said blower is housed, said pull-out blower cartridge being removably received within said blower receiving receptacle and slidable outwardly with said blower from said blower receiving receptacle and from said mattress in response to a pulling force applied to said pull-out blower cartridge.

2. The combination recited in claim 1, wherein said blower cartridge has at least one guide rail running along one side thereof and said blower receiving receptacle has at least one groove formed in at least one side thereof, said at least one guide rail being received within and slidable through said at least one groove when said blower cartridge is received within and removed from said blower receiving receptacle.

3. The combination recited in claim 1, further comprising at least one sensor responsive to a physical parameter to which said mattress is subjected, said at, least one sensor adapted to transmit information concerning the physical parameter to which the at least one sensor is responsive to a data storage site.

4. The combination recited in claim 3, wherein said data storage site is a computer located within said pull-out blower cartridge, said at least one sensor communicating with said computer over a wireless path so that the information concerning the physical parameter to which said at least one sensor is responsive is transmitted to and stored by said computer.

5. The combination recited in claim 4, further comprising a battery located within said pull-out blower cartridge to provide battery power to said computer.

6. The combination recited in claim 4, wherein said at least one sensor is located inside said mattress.

7. The combination recited in claim 6, further comprising a pair of electrical wires electrically connected between said computer located within said pull-out blower cartridge and said at least one sensor located inside said mattress so that power is supplied from said computer to said at least one sensor by way of said pair of electrical wires.

8. The combination recited in claim 7, further comprising a first pair of electrical contacts located on said blower receiving receptacle and electrically connected to respective ones of said pair of electrical wires and a second pair of electrical contacts located on said pull-out blower cartridge and electrically connected to said computer located with said cartridge, said first and second pairs of electrical contacts being detachably connected to one another when said pull-out blower cartridge is removably received within said blower receiving receptacle, whereby said at least one sensor is electrically connected to said computer by way of said pair of electrical wires.

9. The combination recited in claim 8, wherein said first and second pairs of electrical contacts are magnetically held one pair against the other when said pull-out blower cartridge is removably received within said blower receiving receptacle.

10. The combination recited in claim 1, wherein said blower includes an air pump and an electric motor to drive said air pump for providing air to said air plenum and causing said air plenum to be inflated.

11. The combination recited in claim 1, further comprising an air manifold located inside said mattress and running from said blower to said air plenum to supply air from said blower to said air plenum so that said air plenum is inflated.

12. The combination recited in claim 11, wherein said air plenum has a plurality of hollow air chambers and said air manifold has a plurality of air outlets that extend from said air manifold to respective ones of said plurality of air chambers so that air is supplied from said blower to each of said air chambers by way of said air manifold and said plurality of air outlets thereof, whereby said air plenum is inflated.

13. The combination recited in claim 12, where each of said air outlets of said air manifold terminates at an air outlet tip that is located within one of said plurality of air chambers, the cross-sectional area of each of said air outlet tips being larger than the cross-sectional area of each of said air outlets.

14. The combination recited in claim 1, further comprising a sound absorbing barrier located inside said mattress adjacent said blower, said blower receiving air from the atmosphere outside said mattress by way of said sound absorbing harrier.

15. The combination recited in claim 14, wherein said sound absorbing barrier has a tuned blower inlet path winding therethrough through which air is drawn from the atmosphere and supplied to said blower, said tuned blower inlet path having alternating narrow turns and wide straight portions.

16. The combination recited in claim 15, wherein said sound absorbing barrier is a pair of foam blocks that are spaced from one another by said tuned blower inlet path winding therebetween.

17. A combination comprising:

a mattress;

an air plenum located inside said mattress and including a plurality of air chambers to be inflated with air by which to enable said mattress to support the weight of an individual laying thereon, said air plenum adapted to leak some of the air with which said plurality of air chambers are inflated to the atmosphere outside said mattress;

a blower located inside said mattress and coupled to said air plenum to blow air to the plurality of air chambers of said air plenum so that said air chambers are inflated at the same time that air is leaked to the atmosphere;

an air manifold located inside said mattress and running from said blower to said air plenum, said air manifold having a plurality of air outlets extending therefrom into respective ones of said plurality of air chambers so that air is supplied from said blower to said plurality of air chambers by way of said air manifold and said plurality of air outlets thereof in order to inflate said air chambers, each of said air outlets terminating at an outlet tip that is located within one of said plurality of air chambers; and a sound absorbing barrier located inside said mattress at which to communicate with said blower, said sound absorbing barrier having a pair of sound absorbing foam blocks that are separated from one another by a space and a blower inlet path winding through the space between said pair of sound absorbing foam blocks through which air is drawn from the atmosphere outside said mattress to be supplied to the blower located inside said mattress, said blower inlet path having alternating narrow turns and wide straight portions.

18. A combination comprising:

a mattress;

an air plenum located inside said mattress at which to be inflated with air by which to enable said mattress to support the weight of an individual laying thereon, said air plenum adapted to leak some of the air with which it is inflated to the atmosphere outside said mattress;

a blower located inside said mattress and coupled to said air plenum to blow air to said air plenum so that said air plenum is inflated at the same time that air is leaked therefrom to the atmosphere;

a blower receiving receptacle located inside said mattress;

a pull-out blower cartridge within which said blower is housed, said pull-out blower cartridge being removably received within said blower receiving receptacle and slidable outwardly therefrom with said blower in response to a pulling force applied to said pull-out blower cartridge, whereby said blower is uncoupled from said air plenum and removed from inside said mattress for repair or replacement; and at least one sensor located inside the air plenum inside said mattress and responsive to a physical parameter to which said mattress is subjected, said at least one sensor adapted to transmit information concerning the physical parameter from the inside of said mattress to a data storage site.

19. The combination recited in claim 18, further comprising a computer located within said pull-out blower cartridge, said at least one sensor adapted to transmit to said computer the information regarding the physical parameter to which said at least one sensor is responsive over a first wireless communication path, and said computer adapted to transmit said information to said data storage site over a second wireless communication path.

* * * * *